US009833914B2

(12) United States Patent
Sobagaki et al.

(10) Patent No.: US 9,833,914 B2
(45) Date of Patent: Dec. 5, 2017

(54) HAIR CLIPPER

(71) Applicant: PANASONIC CORPORATION, Osaka (JP)

(72) Inventors: Satoshi Sobagaki, Kyoto (JP); Hitoshi Ogawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 375 days.

(21) Appl. No.: 13/838,368

(22) Filed: Mar. 15, 2013

(65) Prior Publication Data

US 2013/0263457 A1 Oct. 10, 2013

(30) Foreign Application Priority Data

Apr. 6, 2012 (JP) ..... 2012-087790

(51) Int. Cl.
*B26B 19/20* (2006.01)

(52) U.S. Cl.
CPC ..... *B26B 19/205* (2013.01); *B26B 19/20* (2013.01)

(58) Field of Classification Search
CPC ..... B26B 19/20; B26B 19/205; B26B 19/38–19/382
USPC ..... 30/43.91, 43.92, 194–203, 208–210, 30/233.5; D28/45–54
See application file for complete search history.

(56) References Cited

U.S. PATENT DOCUMENTS 3,287,805 A * 11/1966 Du Charme ..... 30/202
4,776,095 A 10/1988 Tsujimoto et al.
4,825,546 A * 5/1989 Araki et al. ..... 30/201
4,845,852 A 7/1989 Sukow
4,949,460 A 8/1990 Sterk
(Continued)

FOREIGN PATENT DOCUMENTS

DE 9409433 U1 * 9/1994 ..... B26B 19/20
EP 1612007 A1 * 1/2006 ..... B26B 19/20
(Continued)

OTHER PUBLICATIONS

English translation of Chinese Search Report issued in correspondsing Chinese Application No. 201310113034.7, dated Aug. 27, 2014.

(Continued)

*Primary Examiner* — Jason Daniel Prone
(74) *Attorney, Agent, or Firm* — McDermott Will & Emery LLP

(57) ABSTRACT

The hair clipper of the present invention includes an adjusting device for adjusting a clipping height. The adjusting device includes an attachment, a handle ring, and a connection mechanism. The attachment is allowed to move in a predetermined moving direction relative to a blade block. The handle ring is allowed to rotate around a rotation axis extending along the moving direction. The connection mechanism moves the attachment with rotation of the handle ring. The connection mechanism includes a cam groove and a linking pin allowed to move along the cam groove. The cam groove includes a first side and a second side opposite to each other. The first side includes: plural step parts which are formed in different positions in the moving direction and extend in a direction perpendicular to the moving direction; and a slope part configured to connect the step parts.

14 Claims, 10 Drawing Sheets

(56) References Cited

U.S. PATENT DOCUMENTS 5,050,305 A * 9/1991 Baker et al. ..... 30/201
D320,673 S * 10/1991 Sterk ..... D28/52
5,054,199 A * 10/1991 Ogawa et al. ..... 30/210
5,084,974 A * 2/1992 Sukow et al. ..... 30/201
5,259,115 A * 11/1993 Bluder et al. ..... 30/201
5,327,648 A * 7/1994 Ullmann ..... 30/200
5,367,772 A * 11/1994 Ogawa ..... B26B 19/205 30/233
D363,809 S * 10/1995 Bone ..... B26B 19/06 D28/53
5,898,999 A * 5/1999 Chaouachi et al. ..... 30/201
5,979,060 A * 11/1999 Holzbauer et al. ..... 30/201
6,079,103 A * 6/2000 Melton et al. ..... 30/43.92
D446,605 S * 8/2001 Speh ..... D28/53
6,279,234 B1 * 8/2001 Chaouachi et al. ..... 30/201
D458,411 S * 6/2002 Abraham ..... D28/53
D486,606 S * 2/2004 Goetschi ..... D28/53
6,968,623 B2 * 11/2005 Braun et al. ..... 30/201
D521,683 S * 5/2006 Pepall ..... D28/53
D522,694 S * 6/2006 Shin ..... D28/53
D524,486 S * 7/2006 Ng ..... D28/53
7,100,286 B2 * 9/2006 Nakakura ..... B26B 19/20 30/233.5
7,698,822 B2 * 4/2010 Kostner et al. ..... 30/200
D628,745 S * 12/2010 Dingelstad ..... D28/53
7,992,307 B2 * 8/2011 Smal ..... 30/202
D648,484 S * 11/2011 Geiger ..... D28/53
D697,264 S * 1/2014 Bergese ..... D28/53
D698,084 S * 1/2014 Yoon ..... D28/53
8,844,142 B2 * 9/2014 Kammer ..... 30/201
D718,496 S * 11/2014 Ino ..... D28/53
D722,201 S * 2/2015 Boulanger ..... D28/54
D722,723 S * 2/2015 Nitsch ..... D28/53
D771,315 S * 11/2016 Andersson ..... D28/53
D792,650 S * 7/2017 Mintz ..... D28/53
D793,623 S * 8/2017 Mintz ..... D28/53
2005/0246902 A1 * 11/2005 Poran ..... 30/201
2007/0227011 A1 * 10/2007 Caric ..... 30/123
2008/0066314 A1 * 3/2008 Rapold ..... 30/30
2008/0251503 A1 * 10/2008 Noujaim ..... H05H 1/34 219/121.47
2010/0083508 A1 * 4/2010 Cheng ..... 30/201
2012/0272532 A1 * 11/2012 Sobagaki et al. ..... 30/201
2012/0272533 A1 * 11/2012 Sobagaki et al. ..... 30/201
2016/0144518 A1 * 5/2016 Zijlstra ..... B26B 19/20 30/201
2016/0325443 A1 * 11/2016 Wevers ..... B26B 19/20 30/123
2017/0057104 A1 * 3/2017 Nab ..... B26B 19/3813 30/233.5
2017/0057105 A1 * 3/2017 Darwinkel ..... B26B 19/20 30/202
2017/0072577 A1 * 3/2017 Darwinkel ..... B26B 19/20 30/202
2017/0129113 A1 * 5/2017 Vonk ..... B26B 19/388 30/233.5

FOREIGN PATENT DOCUMENTS

EP 2517844 A1 10/2012
EP 2610039 A1 * 7/2013 ..... B26B 19/20
EP 2647478 A1 * 10/2013
JP S52-36570 U 3/1977
JP 52060751 A * 5/1977
JP 54143372 A * 11/1979
JP 62-114588 A 5/1987
JP 01-214388 A 8/1989
JP 05317537 A * 12/1993
JP 2008-134569 A 6/2008
JP 2012228367 A * 11/2012
JP 2012228368 A * 11/2012
WO WO 2014103178 A1 * 7/2014 ..... B26B 19/20

OTHER PUBLICATIONS

Extended European Search Report issued in Application No. 13162271.4 with Date of completion of the search Jul. 3, 2013.

* cited by examiner

HAIR CLIPPER

CROSS-REFERENCE TO RELATED APPLICATIONS

The application is based upon and claims the benefit of priority of Japanese Patent Application No. 2012-087790, filed on Apr. 6, 2012, the entire contents of which are incorporated herein by reference.

TECHNICAL FIELD

The present invention relates to hair clippers, and particularly to a hair clipper with a clipping height adjusting function.

BACKGROUND ART

In the past, there has been provided an electric hair clipper configured to cut human head hairs by use of a comb-like fixed blade and a comb-like movable blade reciprocated relative to the fixed blade. For example, such an electric hair clipper is configured to vary a clipping height by means of attaching a specific attachment for adjusting the clipping height.

The aforementioned attachment has a comb-like member covering a blade part of the hair clipper, and forms a space between the blade part and a human skin. The clipping height can be varied with a change in an attaching position of the attachment.

In these kinds of hair clippers, a latching mechanism may be adopted for changing the attaching position of the attachment. With regard to a hair clipper with such a latching mechanism, when the attachment is pressed against one's skin, a position of the attachment may be changed. Such a change in the position of the attachment causes a change in the clipping height.

JP 1-214388 A discloses a hair clipper including a main body incorporating a motor therein and a handle ring attached to the main body in such a manner to be allowed to rotate about an axis and to slide in an axial direction. As for this hair clipper, a pin-shaped protrusion protruded from an outer periphery of the main body is engaged with a spiral cam groove formed in an inner periphery of the handle ring, and an attachment with a comb member is linked to an apical end of the handle ring. When the handle ring is rotated, engagement between the spiral cam groove and the protrusion causes the handle ring to move along the axial direction. As a result, the position of the attachment is varied.

In this situation, since a rotational motion is converted into a motion in the axial direction by means of the spiral cam groove and the protrusion, pressing the attachment does not cause a great undesirable backward movement of the attachment. Thus, the clipping height is not greatly changed.

However, the spiral cam groove has an inner surface along its lengthwise direction, and the inner surface is an inclined surface oblique to the axial direction (sliding direction) of the handle ring. Hence, the attachment may be displaced due to a load caused by pressing the attachment against one's skin surface, or due to vibration of the motor. Further, the attachment may be inclined when a pressing direction of the attachment against one's skin is not approximately parallel to a lengthwise direction of the main body. Such displacement or inclination of the attachment may deteriorate an accuracy of the clipping height.

SUMMARY OF INVENTION

In view of the above insufficiency, the present invention has aimed to propose a hair clipper capable of facilitating adjusting a clipping height to a desired height and of keeping the adjusted clipping height constant precisely.

The hair clipper of the first aspect in accordance with the present invention includes a blade block, and an adjusting device for adjusting a clipping height of the blade block. The adjusting device includes an attachment, a handle ring, and a connection mechanism. The attachment is disposed to overlap with the blade block and to be allowed to move in a predetermined moving direction relative to the blade block. The handle ring is formed into a circular hollow cylindrical shape and is disposed to be rotated around a rotation axis extending along the moving direction. The connection mechanism connects the handle ring to the attachment such that the attachment is moved with rotation of the handle ring. The clipping height is determined by a relative position of the attachment to the blade block in the moving direction. The connection mechanism includes a cam groove provided to one of the attachment and the handle ring, and a linking pin provided to the other of the attachment and the handle ring, and placed inside the cam groove so as to be moved along the cam groove. The cam groove includes a first side and a second side opposite to each other in the moving direction. The first side includes plural step parts formed in different positions in the moving direction respectively associated with the different clipping heights, and a slope part configured to connect the step parts. The step parts extend in a direction normal to the moving direction.

As for the hair clipper of the second aspect in accordance with the present invention, in addition to the first aspect, the blade block is provided with a blade section at its end in an apical direction extending along the moving direction. The step part is defined as a surface directed to the apical direction.

As for the hair clipper of the third aspect in accordance with the present invention, in addition to the second aspect, the attachment includes a comb part protruding along the apical direction. The clipping height is determined by a distance between an apical end of the blade section and an apical end of the comb part in the moving direction.

As for the hair clipper of the fourth aspect in accordance with the present invention, in addition to any one of the first to third aspects, the second side includes plural second step parts respectively opposite to the plural step parts, and a second slope part configured to connect the second step parts. The cam groove is designed to hold the linking pin between the step part and the second step part opposite thereto.

As for the hair clipper of the fifth aspect in accordance with the present invention, in addition to the fourth aspect, the second step parts are parallel to the respective opposite step parts.

As for the hair clipper of the sixth aspect in accordance with the present invention, in addition to the fifth aspect, a distance between the step part and the second step part opposite thereto is equal to a dimension of the linking pin in the moving direction.

As for the hair clipper of the seventh aspect in accordance with the present invention, in addition to any one of the first to sixth aspects, the connection mechanism includes a plurality of the linking pins.

As for the hair clipper of the eighth aspect in accordance with the present invention, in addition to the seventh aspect, the plurality of the linking pins are arranged so as to be respectively positioned at the mutual different step parts when one of the linking pins is positioned at one of the step parts.

As for the hair clipper of the ninth aspect in accordance with the present invention, in addition to the seventh or eighth aspect, the connection mechanism includes a plurality of the cam grooves respectively corresponding to the plurality of the linking pins.

As for the hair clipper of the tenth aspect in accordance with the present invention, in addition to the ninth aspect, the cam grooves have mutually different widths. The linking pins are designed to be fitted into the respectively corresponding cam grooves.

As for the hair clipper of the eleventh aspect in accordance with the present invention, in addition to any one of the first to tenth aspects, the attachment includes an attachment part serving as a part overlapping with the blade block, and a slider part serving as a part attached to the handle ring. The attachment part is detachably attached to the slider part.

As for the hair clipper of the twelfth aspect in accordance with the present invention, in addition to any one of the first to eleventh aspects, the blade block includes two comb-like blades arranged to overlap with each other.

As for the hair clipper of the thirteenth aspect in accordance with the present invention, in addition to the twelfth aspect, the hair clipper further includes a main body configured to hold the blade block. The attachment and the handle ring are attached to the main body.

As for the hair clipper of the fourteenth aspect in accordance with the present invention, in addition to the thirteenth aspect, the hair clipper further includes a driving device housed in the main body. The driving device is configured to reciprocate one of the two comb-like blades relative to the other of the two comb-like blades in a predetermined reciprocation direction. The moving direction is defined as a direction crossing the reciprocation direction.

DESCRIPTION OF EMBODIMENTS

Figure 4:
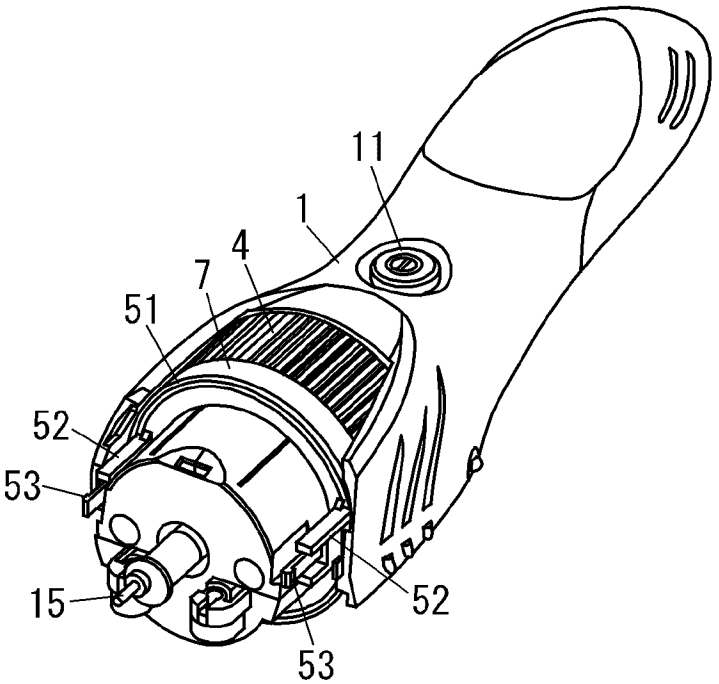
FIG. 4 is a view illustrating the hair clipper without the attachment and a blade block.
Figure 3:
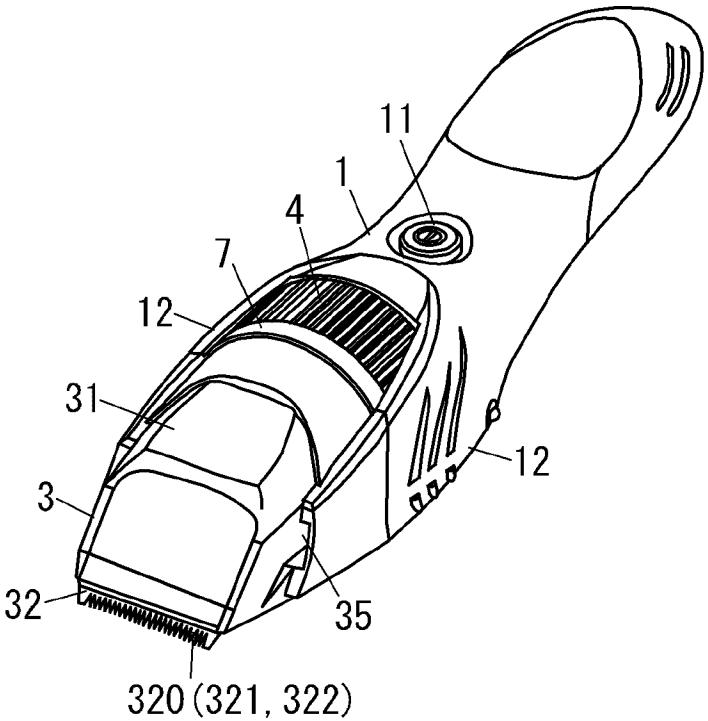
FIG. 3 is a view illustrating the hair clipper without an attachment.
Figure 5:
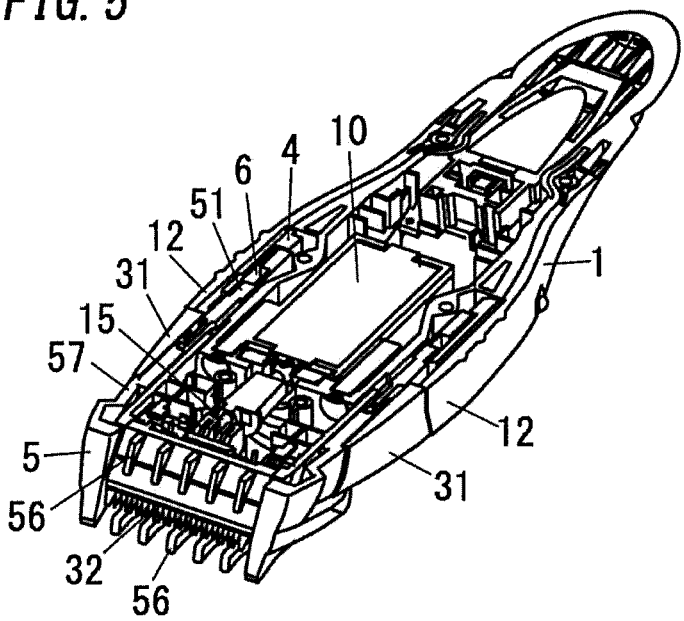
FIG. 5 is a perspective sectional view illustrating the hair clipper.
Figure 6:
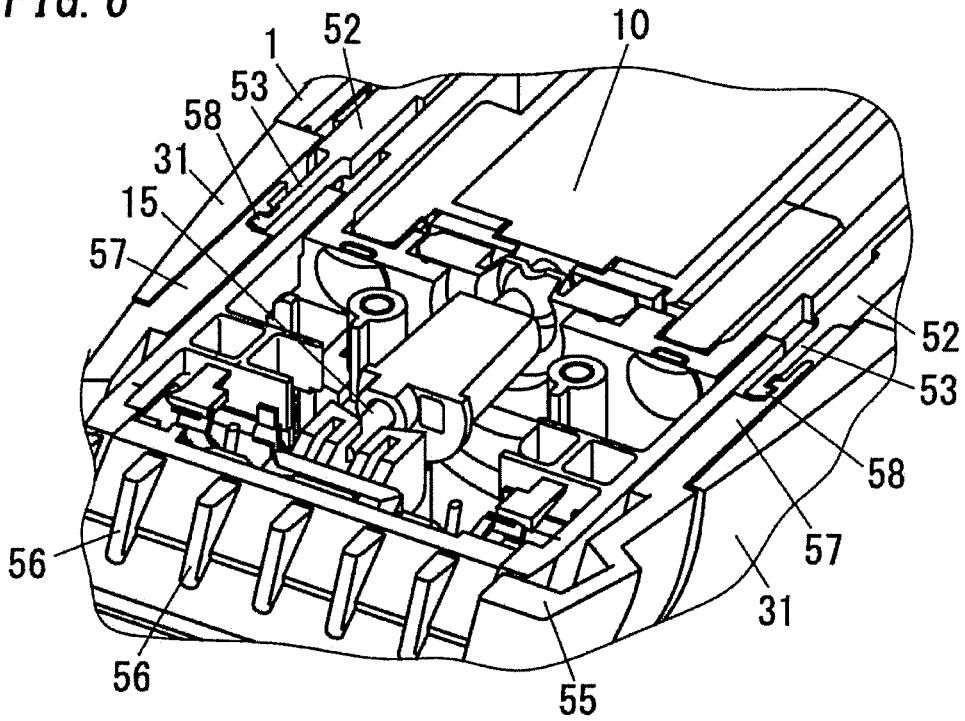
FIG. 6 is a partial expanded view of FIG. 5.

As shown in FIGS. 3 to 6, the hair clipper (electric hair clipper) of one embodiment of the present invention includes a main body 1, and a head 3. The main body 1 incorporates a motor 10 therein. Arranged at a part of the main body 1 close to a front end thereof is a handle ring 4 which is formed into a circular hollow cylindrical shape. The head 3 is detachably coupled to the front end of the main body 1. The head 3 includes a cover block 31 arranged to cover the front end of the main body 1, and a blade block 32 detachably attached to the cover block 31. As shown in FIGS. 3 and 4, the main body 1 is equipped with a power switch 11. Note that, the cover block 31 and the power switch 11 are optional.

The blade block 32 includes a fixed blade provided with a comb-like blade portion and a movable blade provided with a comb-like blade portion in a similar manner as the fixed blade. The movable blade is engaged with an eccentric shaft 15 which is placed on a front surface of the main body 1 and is connected to an output axle of the motor 10. This engagement allows the movable blade to reciprocate in contact with the fixed blade in response to rotation of the motor 10.

As mentioned above, the hair clipper of the present embodiment includes the blade block 32, the main body 1, and the driving device (motor) 10.

The blade block 32 is provided with a blade section 320 at its end in an apical direction. The apical direction is defined as a direction extending along a direction of a central axis of the main body 1. The blade section 320 includes two comb-like blades (fixed and movable blades) 321 and 322 arranged to overlap with each other. The blade block 32 is attached to the end in the apical direction of the body 1.

The driving device 10 is configured to reciprocate one (e.g., the fixed blade) of the two comb-like blades 321 and 322 relative to the other (e.g., the movable blade) of the two comb-like blades 321 and 322 in a predetermined reciprocation direction. For example, the reciprocation direction is a direction crossing the direction of the central axis of the main body 1 (in this embodiment, the reciprocation direction is a direction normal to the direction of the central axis of the main body 1).

The hair clipper of the present embodiment further includes an adjusting device 7 for adjusting a clipping height (length of a remaining hair) of the blade block 32. As shown in FIGS. 5, 13, 15, and 17, the adjusting device 7 includes an attachment 5 and the handle ring 4. Additionally, as shown in FIGS. 10 and 11, the adjusting device 7 includes a connection mechanism connecting the handle ring 4 to the attachment 5.

The attachment 5 is used to determine the clipping height. The attachment 5 is disposed to overlap with the blade block 32 and to be allowed to move in a predetermined moving direction relative to the blade block 32. In the present embodiment, the attachment 5 is attached to the main body 1 movably in the moving direction. For example, the predetermined direction is identical to the direction (upward and downward direction in FIG. 11) of the central axis of the main body 1. In brief, the attachment 5 is attached to the main body 1 so as to be allowed to move along the direction of the central axis of the main body 1.

Figure 7:
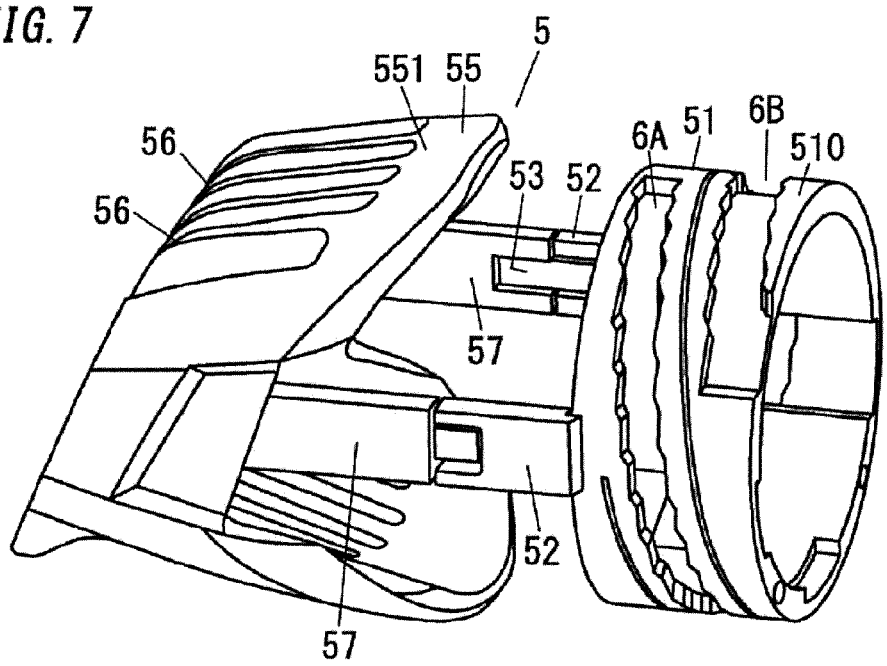
FIG. 7 is a perspective view illustrating the attachment of the hair clipper.
Figure 8:
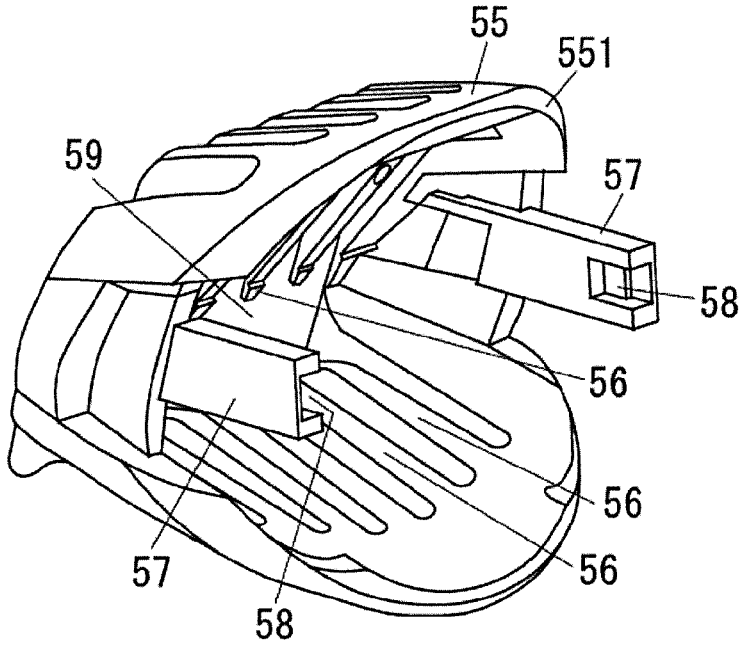
FIG. 8 is a perspective view illustrating an attachment part of the hair clipper.

As shown in FIG. 7, the attachment 5 for adjusting the clipping height attached to this hair clipper includes a slider part 51 formed into a ring shape and an attachment part 55.

Figure 9:
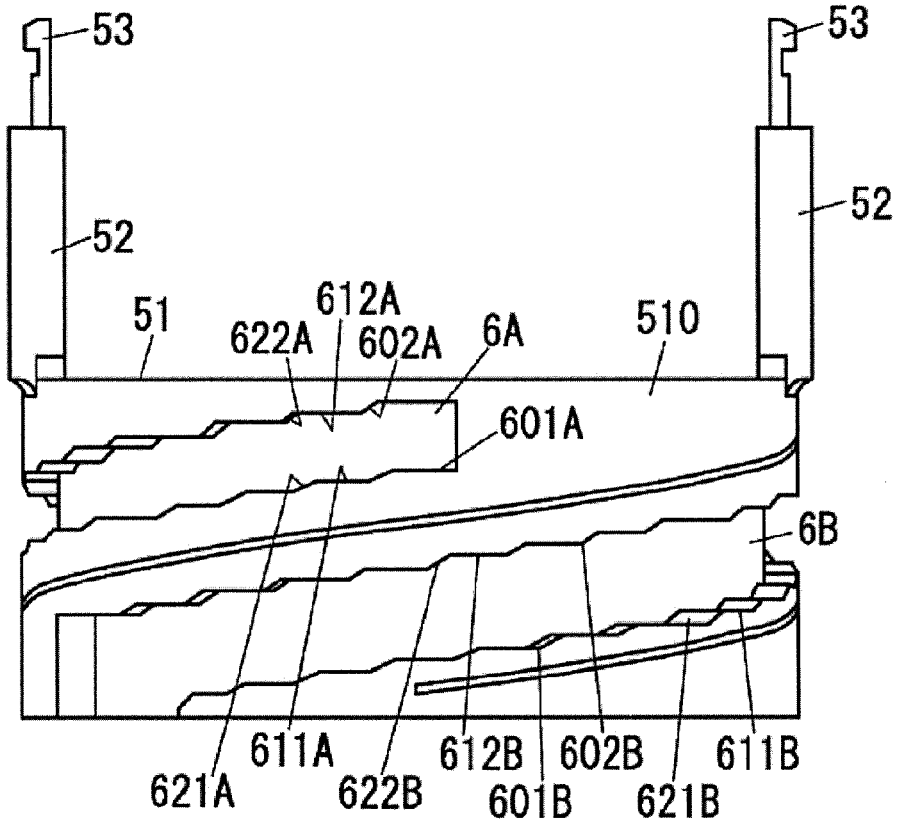
FIG. 9 is a perspective view illustrating a slider part of the hair clipper.
Figure 10:
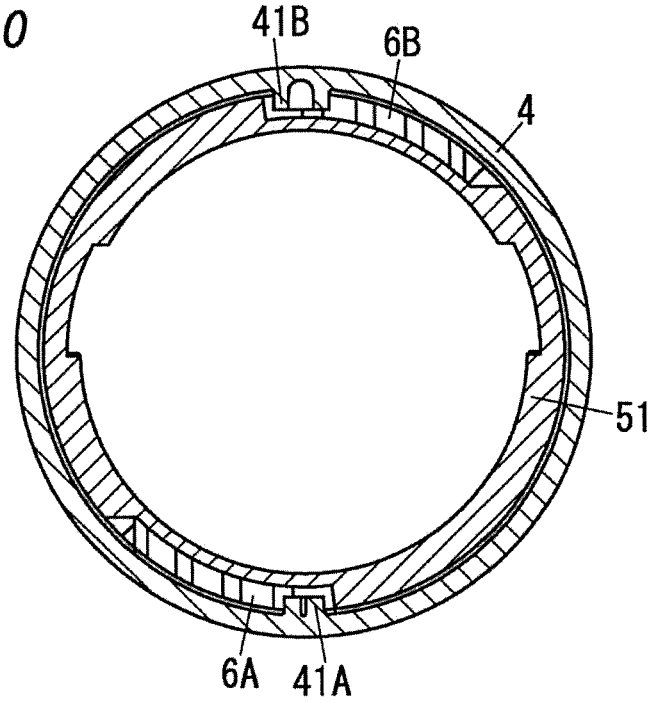
FIG. 10 is a sectional view illustrating the slider part and a handle ring of the hair clipper.
Figure 11:
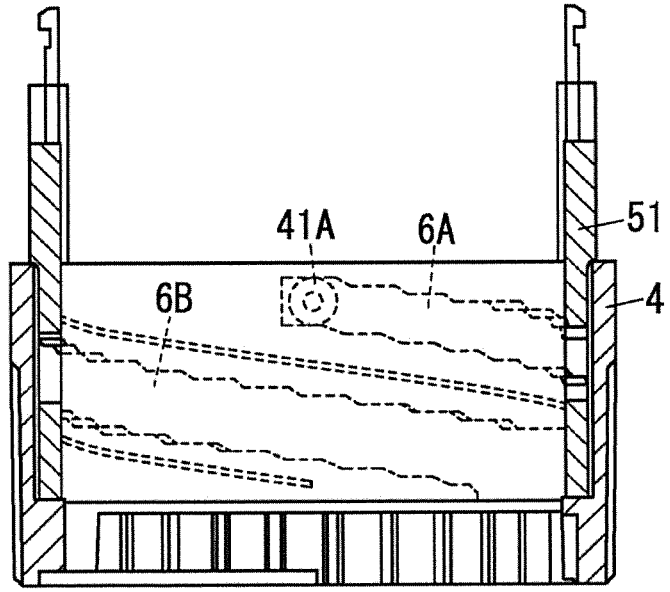
FIG. 11 is a sectional view illustrating the slider part and the handle ring of the hair clipper.

As shown in FIGS. 9 to 11, the slider part 51 includes a body portion 510 formed into a circular hollow cylindrical shape. The body portion 510 is formed to have dimensions such that the body portion 510 can be placed inside the handle ring 4. The slider part 51 is provided with a pair of arm portions 52 protruded from one end (upper end in FIG. 9) in an axial direction of the body portion 510 along the axial direction. Each of the arm portions 52 is provided at its apex with a hooking portion 53 used for connection between the attachment part 55 and the slider part 51.

Further, formed in an outer face (outer periphery) of the body portion 510 are two cam grooves 6A and 6B. The cam groove 6A, 6B is used for connection between the handle ring 4 and the slider part 51.

As mentioned above, the slider part 51 is disposed inside the handle ring 4, and is provided at its outer periphery with the two cam grooves 6A and 6B, and is provided with the pair of the arm portions 52 and 52 extending to an apical side thereof.

The attachment part 55 includes a cap 551 designed to cover the blade block 32. The cap 551 is provided at its one face (front face) with an opening 59 exposing the blade section 320 of the blade block 32. The attachment part 55 includes a plurality of comb parts 56 protruding forward from a vicinity of the opening 59. The comb part 56 serves to adjust the clipping height.

In brief, in the hair clipper of the present embodiment, the clipping height is determined by a relative position of the attachment 5 to the blade block 32 in the moving direction. Especially, the clipping height is determined by a distance between an apical end of the blade section 320 and an apical end of the comb part 56 in the moving direction.

The attachment part 55 further includes a pair of linking arms 57 protruding rearward from the cap 551. Each of the linking arms 57 is provided at its apex with an engagement portion 58 used for connection between the attachment part 55 and the slider part 51. The engagement portion 58 and the hooking portion 53 are designed to engage with each other.

As mentioned above, the attachment part 55 has the comb part 56 overlapping with the blade section 320 at the apex of the blade block 32. The attachment part 55 is provided at ends of the paired linking arms 57 and 57 extending rearward with the engagement portions 58 and 58 which are engaged with the hooking portions 53 and 53 of the arm portions 52 and 52 to be connected to the slider part 51. Besides, the arm portions 52 and 52 are positioned inside through holes 35 provided to the cover block 31 of the head 3 and are linked to the linking arms 57 inside the through holes 35, respectively.

As mentioned above, the attachment 5 includes the attachment part 55 serving as a part overlapping with the blade block 32, and the slider part 51 serving as a part attached to the handle ring 4. The attachment part 55 is detachably attached to the slider part 51.

In the hair clipper of the present embodiment, the clipping height is determined by the relative position of the attachment 5 to the blade block 32 in the moving direction. Especially, in the present embodiment, the clipping height is determined by a distance between the blade section 320 and the comb part 56.

As shown in FIGS. 10 and 11, the handle ring 4 is formed into a circular hollow cylindrical shape. The handle ring 4 is disposed to be rotated around a rotation axis (upward and downward direction in FIG. 11) extending along the moving direction. In the present embodiment, the handle ring 4 is attached to the main body 1 so as to rotate around the rotation axis. The moving direction is defined as a direction extending along the direction of the central axis of the main body 1. Consequently, the handle ring 4 is attached to the main body 1 so as to rotate around the central axis of the main body 1.

As shown in FIG. 10, the slider part 51 of the attachment 5 is placed inside the handle ring 4. Formed in an inner face (inner periphery) of the handle ring 4 are two linking pins 41A and 41B. The linking pin 41A, 41B serves to connect the handle ring 4 to the slider part 51.

As mentioned above, the handle ring 4 encircling the slider part 51 of the attachment 5 is disposed to be allowed to rotate around the axis of the main body 1. The handle ring 4 is provided at its inner periphery (inner peripheral surface) with the two linking pins 41A and 41B. One linking pin 41A is engaged with one (the cam groove 6A) of the two cam grooves 6A and 6B formed in the outer periphery (outer peripheral surface) of the slider part 51, and the other linking pin 41B is engaged with the other cam groove 6B.

Consequently, in the present embodiment, the linking pin 41A, 41B and the cam groove 6A, 6B constitute the connection mechanism connecting the handle ring 4 to the attachment 5 such that the attachment 5 is moved with rotation of the handle ring 4. In other words, the connection mechanism includes the cam groove 6A, 6B provided to the attachment 5 and the linking pin 41A, 41B provided to the handle ring 4. In the present embodiment, the connection mechanism includes the plurality of (two) cam grooves 6A and 6B and the plurality of (two) linking pin 41A and 41B.

The linking pin 41A is placed inside the cam groove 6A so as to be moved along the cam groove 6A. The linking pin 41B is placed inside the cam groove 6B so as to be moved along the cam groove 6B. For example, the linking pin 41A, 41B is formed into a true circular solid cylindrical shape. The two linking pins 41A and 41B have mutually different dimensions in the moving direction. In other words, the two linking pins 41A and 41B have mutually different diameters.

Figure 1:
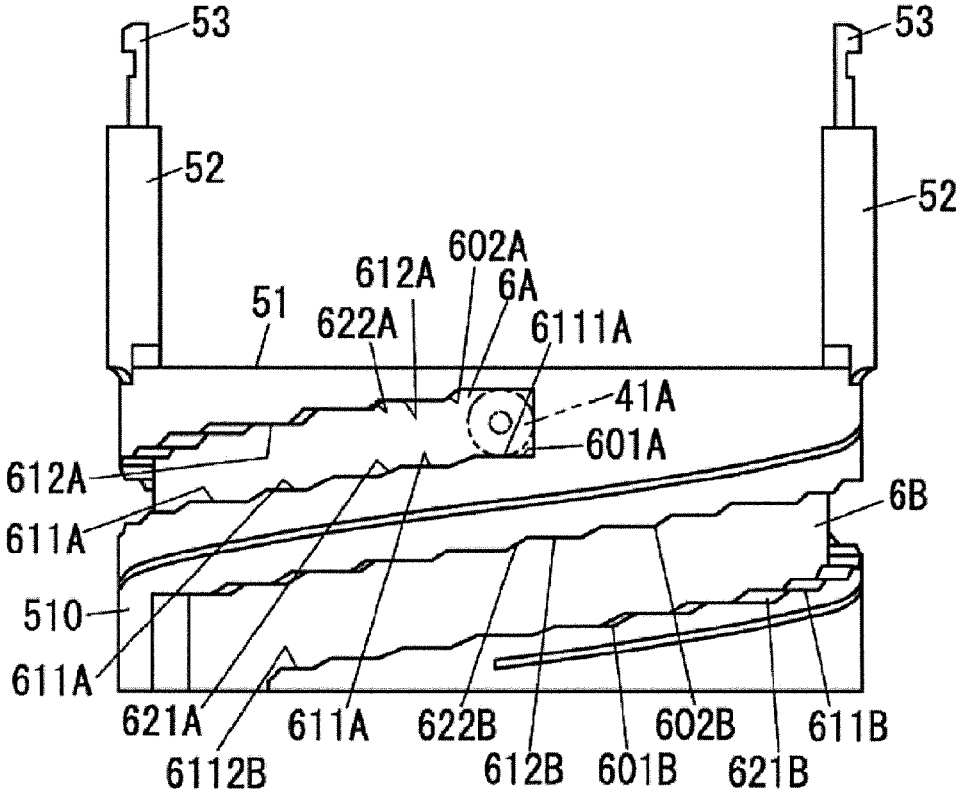
FIG. 1 is a view illustrating a primary part of a hair clipper of one embodiment in accordance with the present invention.
Figure 2:
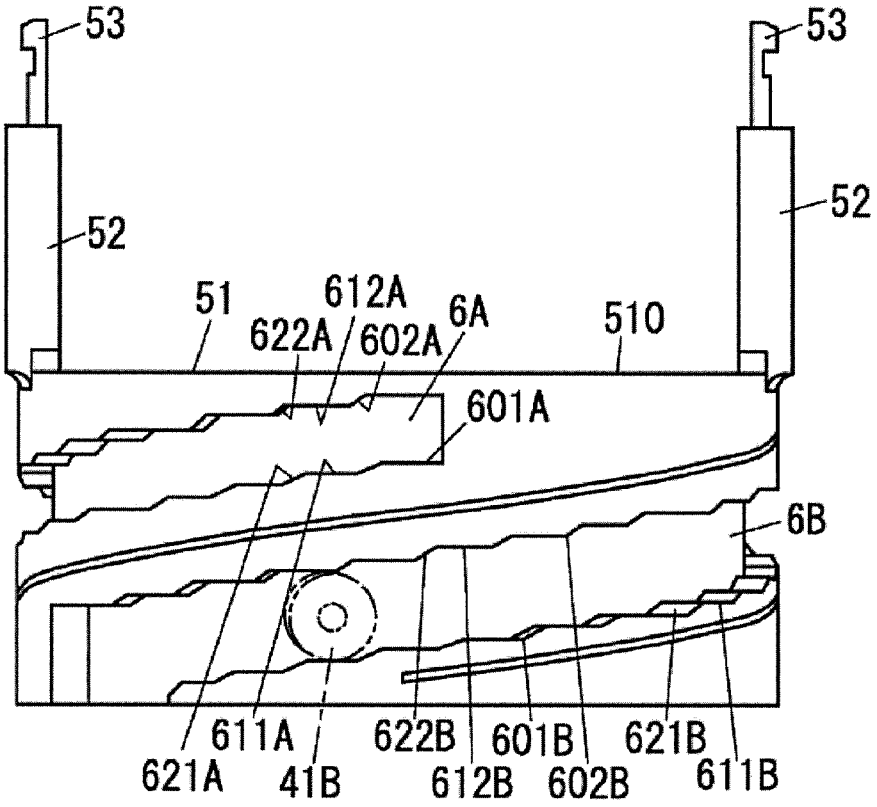
FIG. 2 is a view illustrating a primary part of the hair clipper.

As shown in FIGS. 1 and 2, the cam grooves 6A and 6B extend in a direction across the moving direction (upward and downward direction in FIG. 1). The cam groove 6A is associated with the linking pin 41A and the cam groove 6B is associated with the linking pin 41B.

Each cam groove 6A, 6B includes a first side 601A, 601B and a second side 602A, 602B which are opposite to each other in the moving direction. The first side 601A, 601B is defined as a surface far from the blade block 32, and the second side 602A, 602B is defined as a surface close to the blade block 32.

The first side 601A, 601B includes plural (first) step parts 611A, 611B extending in a direction normal to the moving direction, and a (first) slope part 621A, 621B configured to connect the (adjacent) step parts 61 (611) (to each other). In the present embodiment, the first side 601A, 601B includes a plurality of the step parts 611A, 611B and a plurality of the slope parts 621A, 621B.

The step parts 611A, 611B are formed in different positions in the moving direction respectively associated with the different clipping heights. The plural step parts 611A, 611B include the step part 6111A, 6111B (see FIG. 1) associated with the lowest clipping height and the step part 6112A, 6112B (see FIG. 16) associated with the highest clipping height. The step part 6111A, 6111B associated with the lowest clipping height is one of the plural step parts 611A, 611B and is closest to the blade block 32. The step part 6112A, 6112B associated with the highest clipping height is one of the plural step parts 611A, 611B and is farthest from the blade block 32.

Further, the step parts 611A, 611B are formed in different positions in a circumferential direction of the slider part 51. In the present embodiment, the plural step parts 611A, 611B are flat surfaces orthogonal to the moving direction, and are parallel to each other. The step parts 611A, 611B are surfaces which are directed to the side of the blade block 32 (i.e., the apical direction).

Each of the slope parts 621A, 621B is configured to connect the adjacent step parts 611A, 611B to each other. In the present embodiment, the plural slope parts 621A, 621B are flat surfaces across the moving direction, and are parallel to each other.

The second side 602A, 602B includes plural (second) step parts 612A, 612B respectively opposite to the plural step parts 611A, 611B, and a (second) slope part 622A, 622B configured to connect the (adjacent) second step parts 612A, 612B (to each other). In the present embodiment, the second side 602A, 602B includes a plurality of the second step parts 612A, 612B and a plurality of the second slope parts 622A, 622B.

The second step parts 612A, 612B are parallel to respective opposite step parts 611A, 611B. In other words, the second step parts 612A, 612B are formed in different positions in the moving direction respectively associated with the different clipping heights. Further, the second step parts 611A, 611B are formed in different positions in the circumferential direction of the slider part 51. In the present embodiment, the plural second step parts 612A, 612B are flat surfaces orthogonal to the moving direction, and are parallel to each other.

Each of the second slope parts 622A, 622B is configured to connect the adjacent second step parts 612A, 612B to each other. In the present embodiment, the plural second slope parts 622A, 622B are flat surfaces across the moving direction, and are parallel to each other.

With respect to the cam groove 6A, 6B, the step part 611A, 611B and the second step part 612A, 612B opposite to this step part 611A, 611B constitute a holding groove determining the clipping height. In the present embodiment, each of the step part 611A, 611B and the second step part 612A, 612B is a flat surface perpendicular to the moving direction. Thus, each holding groove extends orthogonal to the moving direction. In addition, each of the holding grooves has its opposite inner sides parallel to each other. Further, the slope part 621A, 621B and the second slope part 622A, 622B opposite to this slope part 621A, 621B constitute a connection groove configured to connect the (adjacent) holding grooves (to each other).

Consequently, the cam groove 6A, 6B is considered as being constituted by the plural holding grooves associated with respective different clipping heights and the connection grooves configured to connect holding grooves.

The plural holding grooves have the same width. The width of the holding groove is equal to a distance between the step part 611A, 611B and the second step part 612A, 612B opposite to this step part 611A, 611B (a distance between the opposite inner sides of holding groove). The width of the holding groove is defined as a width of the cam groove at the step part 611A, 611B of the first side 601A, 601B (or the second step part 612A, 612B of the second side 602A, 602B).

In the present embodiment, the width of the holding groove is identical to the dimension of the linking pin 41A, 41B in the moving direction (i.e., the diameter of the linking pin 41A, 41B). For example, the width of the holding groove of the cam groove 6A is identical to the dimension of the linking pin 41A in the moving direction (i.e., the diameter of the linking pin 41A). Further, the width of the holding groove of the cam groove 6B is identical to the dimension of the linking pin 41B in the moving direction (i.e., the diameter of the linking pin 41B).

The plural connection grooves have the same width. The width of the connection groove is equal to a distance between the slope part 621A, 621B and the second slope part 622A, 622B opposite to this slope part 621A, 621B. The width of the connection groove is defined as a width of the cam groove at the slope part 621A, 621B of the first side 601A, 601B (or the second slope part 622A, 622B of the second side 602A, 602B). In the present embodiment, the width of the connection groove is identical to the dimension of linking pin 41A, 41B in the moving direction (i.e., the diameter of the linking pin 41A, 41B). For example, the width of the connection groove of the cam groove 6A is identical to the dimension of linking pin 41A in the moving direction (i.e., the diameter of the linking pin 41A). Further, the width of the connection groove of the cam groove 6B is identical to the dimension of linking pin 41B in the moving direction (i.e., the diameter of the linking pin 41B).

In brief, as for the present embodiment, the cam groove 6A, 6B has the width identical to the dimension (diameter) of the corresponding linking pin 41A, 41B in the moving direction. In other words, the linking pins 41A and 41B are designed to be fitted into the respectively corresponding cam grooves 6A and 6B.

Hence, the linking pin 41A is positioned in the holding groove in such a manner to be in contact with the opposite inner sides (the step part 611A and the second step part 612A) of the holding groove of the cam groove 6A. Additionally, the linking pin 41B is positioned in the holding groove in such a manner to be in contact with the opposite inner sides (the step part 611B and the second step part 612B) of the holding groove of the cam groove 6B. Consequently, the attachment 5 is prevented from moving in the moving direction.

In the present embodiment, as shown in FIG. 10, the two linking pins 41A and 41B face each other in a direction (upward and downward direction in FIG. 10) normal to a direction of a central axis of the handle ring 4. Thus, the two linking pins 41A and 41B are arranged so as to be respectively positioned at the mutual different step parts 611A, 612A, 611B, 612B when one of the linking pins 41A and 41B is positioned at one of the step parts 611A, 612A, 611B, 612B. As for the present embodiment, when the linking pin 41A is positioned at any one of the step parts 611A, 612A, 611B, 612B of the cam groove 6A, the linking pin 41B is positioned at any one of the step parts 611A, 612A, 611B, 612B of the cam groove 6B.

The two cam grooves 6A and 6B provided to the slider part 51 are spiral and are inclined relative to an axial direction of the handle ring 4. Thus, the slider part 51 moves forward or rearward with rotation of the handle ring 4 around the axis thereof. According to such rotation, the attachment part 55 connected to the slider part 51 also moves forward or rearward.

Such forward and rearward movement of the attachment part 55 varies an interval between the blade section 320 of the blade block 32 and the comb part 56 of the attachment part 55. Thus, in a situation where hairs are cut by the blade block 32 while the comb part 56 is in contact with one's skin, it is possible to adjust the clipping height.

Figure 12:
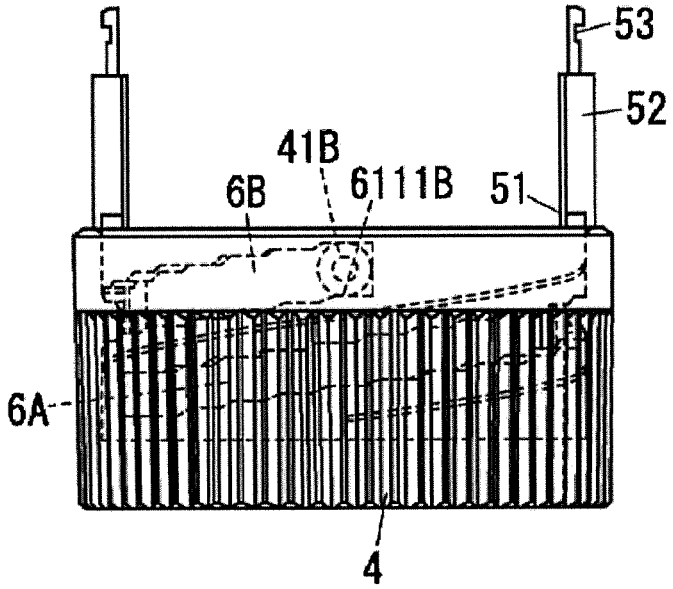
FIG. 12 is a view illustrating a position relation between the slider part and the handle ring of the hair clipper.
Figure 13:
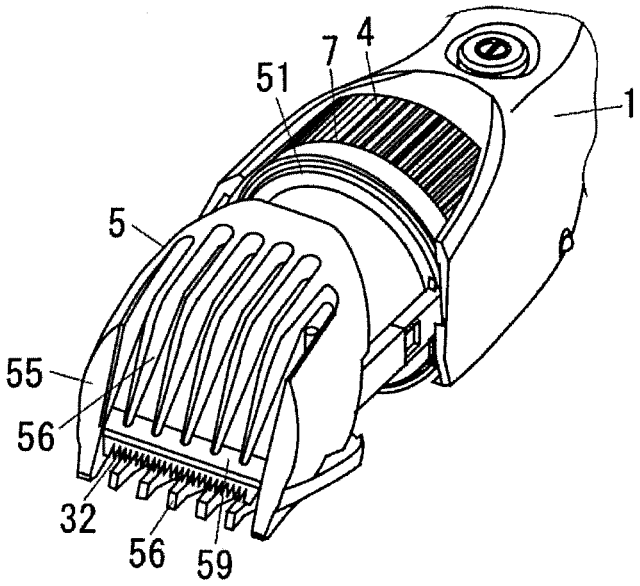
FIG. 13 is a view illustrating a position relation between the blade block and the attachment part of the hair clipper.

FIG. 12 shows a positional relation between the slider part 51 and the handle ring 4 in a situation where the clipping height is the lowest level. When the clipping height is the lowest level, as shown in FIGS. 1 and 12, the linking pins 41A and 41B are positioned at the step parts 6111A and 6111B of the respective corresponding cam grooves 6A and 6B. In this situation, as shown in FIG. 13, the distance between the apical (front) end of the blade block 32 (i.e., the apical end of the blade section 320) and the apical (front) end of the attachment part 55 (i.e., the apical end of the comb part 56) in the moving direction is the shortest. Hence, the clipping height becomes the lowest level.

Figure 14:
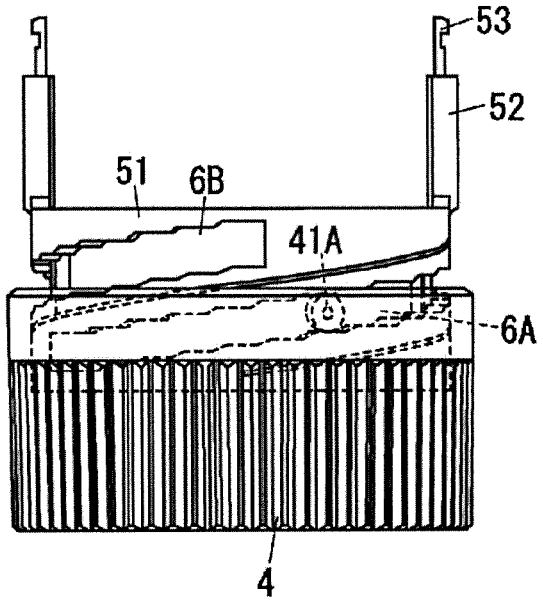
FIG. 14 is a view illustrating a position relation between the slider part and the handle ring of the hair clipper.

To increase the clipping height, the handle ring 4 is rotated such that, as shown in FIG. 14, the linking pin 41A, 41B is moved from the step part 611A, 611B corresponding to the lowest clipping height to the step part 611A, 611B corresponding to the clipping height higher than that of the step part 6111A, 6111B. In the present embodiment, the handle ring 4 is rotated along a clockwise direction in FIG. 11 (a direction represented by an arrow 100 in FIG. 15).

Figure 15:
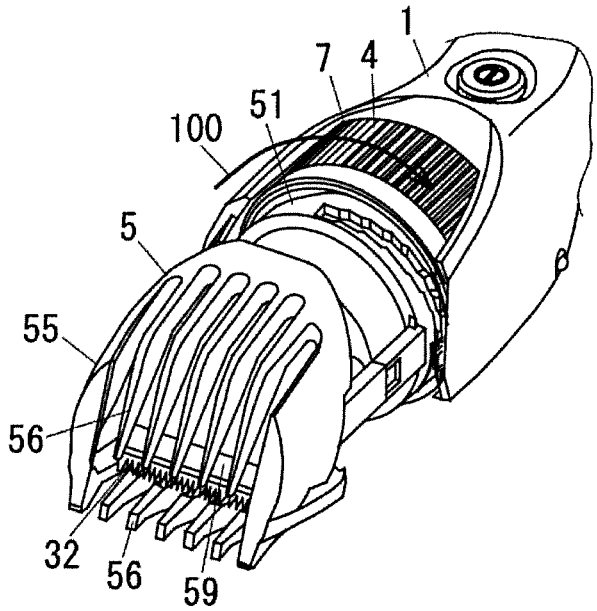
FIG. 15 is a view illustrating a position relation between the blade block and the attachment part of the hair clipper.

In this situation, as shown in FIG. 15, the distance between the apical (front) end of the blade block 32 (i.e., the apical end of the blade section 320) and the apical (front) end of the attachment part 55 (i.e., the apical end of the comb part 56) in the moving direction is increased, and the clipping height is also increased.

Figure 16:
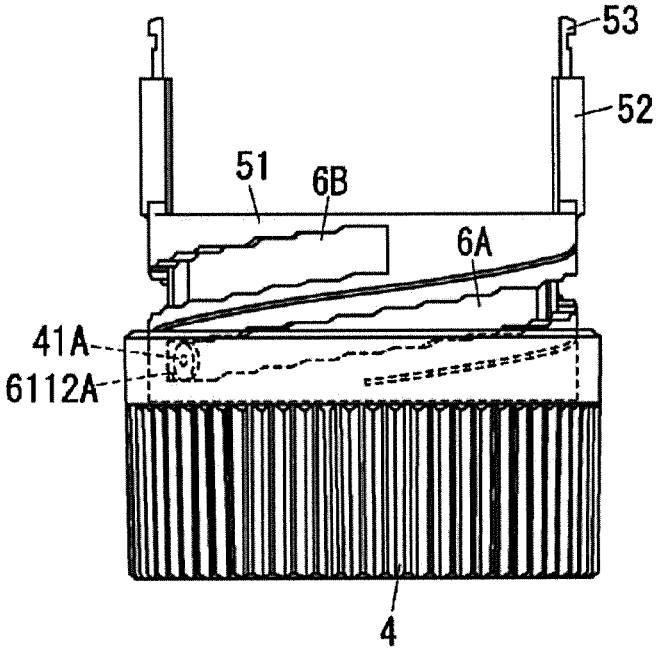
FIG. 16 is a view illustrating a position relation between the slider part and the handle ring of the hair clipper.
Figure 17:
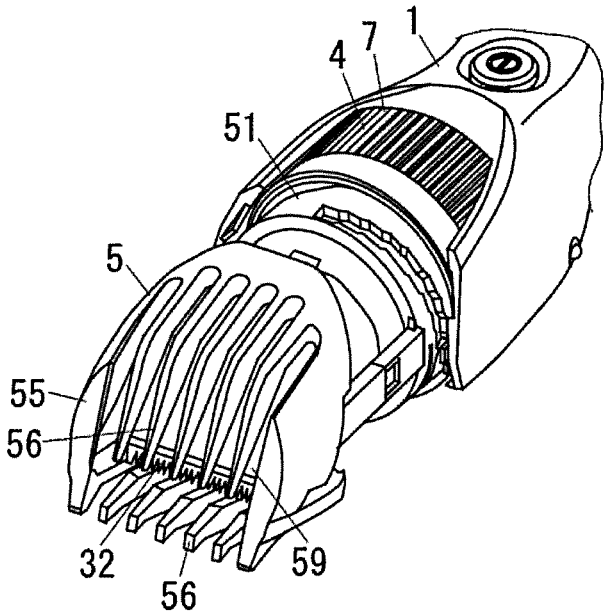
FIG. 17 is a view illustrating a position relation between the blade block and the attachment part of the hair clipper.

When the handle ring 4 is further rotated, finally, the linking pin 41A, 41B reaches the step part 6112A, 6112B corresponding to the highest clipping height. FIG. 16 shows a positional relation between the slider part 51 and the handle ring 4 in a situation where the clipping height is the highest level. When the clipping height is the highest level, as shown in FIG. 16, the linking pins 41A and 41B are positioned at the step parts 6112A and 6112B of the respective corresponding cam grooves 6A and 6B. In this situation, as shown in FIG. 17, the distance between the apical (front) end of the blade block 32 (i.e., the apical end of the blade section 320) and the apical (front) end of the attachment part 55 (i.e., the apical end of the comb part 56) in the moving direction is the longest. Hence, the clipping height becomes the highest level.

In this embodiment, a pair of lengthwise sides (the first side and the second side) 601A, 601B and 602A, 602B in the axial direction of each of the cam grooves 6A, 6B is formed into a stepwise shape.

In other words, as shown in FIG. 9, the lengthwise side 601A, 601B, 602A, 602B includes the step parts 611A, 612A, 611B, 612B substantially normal to the axial direction (sliding direction of the slider part 51) of the handle ring 4 and the slope parts 621A, 622A, 621B, 622B connecting the next step parts 611A, 612A, 611B, 612B formed at different positions in the axial direction.

As shown in FIGS. 1 and 2, when the linking pin 41A, 41B which is circular (or elliptical, or polygonal) in cross section is positioned between any one of the step parts 611A, 611B of one lengthwise side (first side) 601A, 601B of the cam groove 6A, 6B and the step parts 612A, 612B of the other lengthwise side (second side) 602A, 602B arranged opposite to this step part 611A, 611B in the axial direction, the clipping height is held at a desired level. When the linking pin 41A, 41B is moved to a different pair of the lengthwise sides 601A, 601B through a path between the slope parts 621A, 621B and 622A, 622B of the paired lengthwise sides 601A, 601B and 602A, 602B, the clipping height becomes a different level.

Note that, in the illustrated instance, the clipping height is adjustable in twenty levels with an interval of 0.5 mm. Based on the assumption that the hair clipper is used for clipping not only hairs but also whiskers, the hair clipper is designed such that the clipping height can be adjusted finely.

The paired lengthwise sides 601A, 601B and 602A, 602B of the cam groove 6A, 6B are formed into stepwise shapes. Thus, when the clipping height is set, the linking pin 41A, 41B is positioned between the step parts 611A, 611B and 612A, 612B opposite to each other in the axial direction.

According to this configuration, a clearance in the sliding direction (moving direction) of the slider part 51 is quite small. Further, even when the handle ring 4 is slightly moved in the rotation direction, the linking pin 41A, 41B is held between the opposite step parts 611A, 611B and 612A, 612B. Hence, a force to cause movement of the slider part 51 in the axial direction does not occur.

To reduce a possibility that the handle ring 4 is rotated unexpectedly, the main body 1 is provided at its sides with extension parts 12 and 12 designed to cover the outer periphery of the handle ring 4 to reduce an exposed area of the handle ring 4.

Besides, in the present embodiment, the linking pin 41A, 41B is provided to the handle ring 4 and the cam groove 6A, 6B is provided to the slider part 51. The cam groove 6A, 6B may be provided to the inner periphery of the handle ring 4 and the linking pin 41A, 41B may be provided to the outer periphery of the slider part 51. In other words, it is sufficient that the connection mechanism includes the cam groove 6A, 6B provided to one of the attachment 5 and the handle ring 4 and the linking pin 41A, 41B provided to the other of the attachment 5 and the handle ring 4.

Further, in the present embodiment, each of the paired lengthwise sides 601A, 601B and 602A, 602B in the axial direction of the cam groove 6A, 6B is formed into a stepwise shape. However, it is sufficient that either one of the paired lengthwise sides 601A, 601B and 602A, 602B in the axial direction of the cam groove 6A, 6B is formed into a stepwise shape. In this situation, preferably, the lengthwise side (the first side 601A, 601B in the present embodiment) which comes in contact with the linking pin 41A, 41B when the attachment 5 is pressed against one's skin is formed into a stepwise shape. For example, when the slider part 51 is provided with the cam groove 6A, 6B, the lengthwise side 601A, 602A, 601B, 602B close to the attachment part 55 is formed into a stepwise shape, preferably. Meanwhile, when the handle ring 4 is provided with the cam groove 6A, 6B, the lengthwise side 601A, 602A, 601B, 602B which is an opposite side of the cam groove 6A, 6B from the attachment part 55 is formed into a stepwise shape, preferably.

Moreover, the step part 611A, 612A, 611B, 612B in the cam groove 6A, 6B is not necessarily shaped into a flat surface but may be shaped into a curved surface.

In the illustrated instance, to smoothly change the clipping height by means of moving forward or rearward the attachment 5, the two cam grooves 6A, 6B are provided at an angular interval of 180 degree. Further in the illustrated instance, since the paired arm portions 52 and 52 are close to one side, the arm portions 52 are not in mutually symmetrical positions. Hence, to prevent improper assembly, the two cam grooves 6A and 6B have mutually different widths (the linking pins 41A and 41B have mutually different thickness).

To enable detachment of the attachment part 55, the attachment 5 is separated into the attachment part 55 and the slider part 51. The arm portion 52 of the slider part 51 for connection can be elastically bent inward within the inside of the through hole 35 of the cover block 31. The detachment of the attachment part 55 from the slider part 51 can be performed irrespective of the level of the clipping height.

In brief, the attachment part 55 can be attached and detached without changing the clipping height from the desired level. The present embodiment has the greatly improved usability in contrast to a configuration where the attachment part 55 cannot be attached and detached unless the clipping height is set to the highest level.

Although the detachment is easy, the connection between the attachment part 55 and the slider part 51 is made inside the through hole 35 of the cover block 31. Therefore, the unexpected detachment can be prevented. Even when the attachment part 55 is pressed against one's skin, the arm portion 52 supports the attachment part 55 at its apical end, and therefore the attachment part 55 can be prevented from being moved backward. Further, even when the attachment part 55 is detached, the arm portion 52 of the slider part 51 is covered with the cover block 31 and is not exposed outside. Thus, there is no possibility that the arm portion 52 catches in hairs.

As mentioned in the above, the hair clipper of the present embodiment includes: the fixed blade having the comb-like blade part; the movable blade having the comb-like blade part and moved in a reciprocation manner; the main body 1 incorporating the driving means (the motor 10) for reciprocating the movable blade; the attachment 5 disposed overlapping with the apical blade parts of the fixed blade and the movable blade and used for adjustment of the clipping height; and the handle ring 4 disposed to the main body 1 in such a manner to be allowed to rotate around a direction substantially normal to the sliding direction. One of the attachment 5 and the handle ring 4 is provided with the spiral cam groove 6A, 6B, and the other is provided with the linking pin 41A, 41B. The attachment 5 is allowed to slide in a blade edge direction normal to the reciprocation direction of the movable blade. The linking pin 41A, 41B is allowed to slide inside the cam groove 6A, 6B. The linking pin 41A, 41B is moved inside the cam groove 6A, 6B with the rotation of the handle ring 4. Such movement of the linking pin 41A, 41B causes the attachment 5 to slide. As a result, the clipping height is adjusted. The cam groove 6A, 6B has the pair of the opposite lengthwise sides 601A, 602A, 601B, 602B, and one of the lengthwise sides 601A, 602A, 601B, 602B is formed into a stepwise shape so as to include the plural step parts 611A, 612A, 611B, 612B substantially normal to the sliding direction and the slope part 621A, 622A, 621B, 622B crossing the sliding direction obliquely and connecting between the step parts 611A, 612A, 611B, 612B. The linking pin 41A, 41B is positioned at the step part 611A, 612A, 611B, 6128 of one lengthwise side 601A, 602A, 601B, 602B and holds the selected clipping height.

In other words, the hair clipper of the present embodiment includes the following first feature. In the first feature, the hair clipper includes the blade block 32, and the adjusting device 7 for adjusting the clipping height of the blade block 32. The adjusting device 7 includes the attachment 5, the handle ring 4, and the connection mechanism. The attachment 5 is disposed to overlap with the blade block 32 and to be allowed to move in the predetermined moving direction relative to the blade block 32. The handle ring 4 is formed into the circular hollow cylindrical shape and is disposed to be rotated around the rotation axis extending along the moving direction. The connection mechanism connects the handle ring 4 to the attachment 5 such that the attachment 5 is moved with rotation of the handle ring 4. The clipping height is determined by the relative position of the attachment 5 to the blade block 32 in the moving direction. The connection mechanism includes the cam groove 6A, 6B provided to one of the attachment 5 and the handle ring 4, and the linking pin 41A, 41B provided to the other of the attachment 5 and the handle ring 4, and placed inside the cam groove 6A, 6B so as to be moved along the cam groove 6A, 6B. The cam groove 6A, 6B includes the first side 601A, 601B and the second side 602A, 602B opposite to each other in the moving direction. The first side 601A, 601B includes plural step parts 611A, 611B formed in different positions in the moving direction respectively associated with the different clipping heights, and the slope part 621A, 621B configured to connect the step parts 611A, 611B. The step parts 611A, 611B extend in a direction normal to the moving direction.

Further, in the hair clipper of the present embodiment, the lengthwise side 601A, 601B, 602A, 602B which comes in contact with the linking pin 41A, 41B when the attachment 5 receives a force rolling back the attachment 5, is adopted as the lengthwise side 601A, 601B, 602A, 602B including the step parts 611A, 612A, 611B, 612B and the slope parts 621A, 622A, 621B, 622B.

In other words, the hair clipper of the present embodiment includes the following second feature in addition to the first feature. In the second feature, the blade block 32 is provided with the blade section 320 at its end in the apical direction extending along the moving direction. The step part 611A, 611B is defined as a surface directed to the apical direction. Note that, the second feature is optional.

Moreover, the hair clipper of the present embodiment includes the following third feature in addition to the second feature. In the third feature, the attachment 5 includes the comb part 56 protruding along the apical direction. The clipping height is determined by the distance between the apical end of the blade section 320 and the apical end of the comb part 56 in the moving direction. Note that, the third feature is optional.

Additionally, in the hair clipper of the present embodiment, the pair of the opposite lengthwise sides 601A, 602A and 601B, 602B of the cam groove 6A, 6B is formed into a stepwise shape so as to include the plural step parts 611A, 612A, 611B, 612B substantially normal to the sliding direction and the slope part 621A, 622A, 621B, 622B crossing the sliding direction obliquely and connecting between the step parts 611A, 612A, 611B, 612B. The linking pin 41A, 41B is positioned between the step part 611A, 612A, 611B, 612B of one lengthwise side 601A, 601B, 602A, 602B and the step part 611A, 612A, 611B, 612B of the other lengthwise side 601A, 601B, 602A, 602B and holds the selected clipping height.

In other words, the hair clipper of the present embodiment includes the following fourth feature in addition to any one of the first to third features. In the fourth feature, the second side 602A, 602B includes the plural second step parts 612A, 612B respectively opposite to the plural step parts 611A, 611B, and the second slope part 622A, 622B configured to connect the second step parts 612A, 612B. The cam groove 6A, 6B is designed to hold the linking pin 41A, 41B between the step part 611A, 611B and the second step part 612A, 612B opposite thereto. Note that, the fourth feature is optional.

Further, the hair clipper of the present embodiment includes the following fifth feature in addition to the fourth feature. In the fifth feature, the second step parts 612A, 612B are parallel to the respective opposite step parts 611A, 611B. Note that, the fifth feature is optional.

Furthermore, the hair clipper of the present embodiment includes the following sixth feature in addition to the fifth feature. In the sixth feature, the distance between the step part 611A, 611B and the second step part 612A, 612B opposite to this step part 611A, 611B is equal to the dimension of the linking pin 41A, 41B in the moving direction. Note that, the sixth feature is optional.

Additionally, in the hair clipper of the present embodiment, the plurality of the linking pins 41A, 41B is provided. The linking pins 41A, 41B slide at respective different positions in the cam groove 6A, 6B.

In other words, the hair clipper of the present embodiment includes the following seventh feature in addition to any one of the first to sixth features. In the seventh feature, the connection mechanism includes a plurality of the linking pins 41A, 41B. Note that, the seventh feature is optional.

Further, the hair clipper of the present embodiment includes the following eighth feature in addition to the seventh feature. In the eighth feature, the plurality of the linking pins 41A, 41B are arranged so as to be respectively positioned at the mutual different step parts 611A, 611B when one of the linking pins 41A, 41B is positioned at one of the step parts 611A, 611B. Note that, the eighth feature is optional. Hence, a plurality of the linking pins 41A, 41B may be arranged so as to be positioned at the same step part 611A, 611B.

Additionally, in the hair clipper of the present embodiment, the plural spiral cam grooves 6A and 6B are parallel to each other. The plural linking pins 41A, 41B slide inside the respective corresponding cam grooves 6A and 6B. Further, the cam grooves 6A and 6B have mutually different widths and the linking pins 41A and 41B have mutually different thicknesses.

In other words, the hair clipper of the present embodiment includes the following ninth feature in addition to the seventh or eighth feature. In the ninth feature, the connection mechanism includes a plurality of the cam grooves 6A and 6B respectively corresponding to a plurality of the linking pins 41A and 41B. Note that, the ninth feature is optional.

Moreover, the hair clipper of the present embodiment includes the following tenth feature in addition to the ninth feature. In the tenth feature, the cam grooves 6A and 6B have mutually different widths. The linking pins 41A and 41B are designed to be fitted into the respectively corresponding cam grooves 6A and 6B. Note that, the tenth feature is optional.

Additionally, in the hair clipper of the present embodiment, the attachment 5 is constituted by the slider part 51 provided with either the cam groove 6A, 6B or the linking pin 41A, 41B and the attachment part 55 overlapped with the apical blade section 320 of the fixed blade and the movable blade. The attachment part 55 is detachably connected to the slider part 51 irrespective of the sliding position of the slider part 51.

In other words, the hair clipper of the present embodiment includes the following eleventh feature in addition to any one of the first to tenth features. In the eleventh feature, the attachment 5 includes the attachment part 55 serving as a part overlapping with the blade block 32, and the slider part 51 serving as a part attached to the handle ring 4. The attachment part 55 is detachably attached to the slider part 51. Note that, the eleventh feature is optional.

Further, the hair clipper of the present embodiment includes the following twelfth feature in addition to any one of the first to eleventh features. In the twelfth feature, the blade block 32 includes the two comb-like blades 321 and 322 arranged to overlap with each other. Note that, the twelfth feature is optional.

Furthermore, the hair clipper of the present embodiment includes the following thirteenth feature in addition to the twelfth feature. In the thirteenth feature, the hair clipper further includes the main body 1 configured to hold the blade block 32. The attachment 5 and the handle ring 4 are attached to the main body 1. Note that, the thirteenth feature is optional.

Moreover, the hair clipper of the present embodiment includes the following fourteenth feature in addition to the thirteenth feature. In the fourteenth feature, the hair clipper further includes the driving device (motor) 10 housed in the main body 1. The driving device 10 is configured to reciprocate one of the two comb-like blades 321 and 322 relative to the other of the two comb-like blades 321 and 322 in the predetermined reciprocation direction. The moving direction is defined as a direction crossing the reciprocation direction. Note that, the fourteenth feature is optional.

According to the hair clipper of the present embodiment, with rotating the handle ring 4, it is possible to easily vary the clipping height. Additionally, since each of the paired opposite lengthwise sides 601A and 602A, 601B and 602B of the cam groove 6A, 6B provided to one of the handle ring 4 and the attachment 5 is formed into a stepwise shape, movable range of the linking pin 41A, 41B is narrow at a position corresponding to the selected level of the clipping height. Consequently, the clipping height can be kept at the selected level precisely.

The invention claimed is:

1. A hair clipper comprising:

two comb-shaped blades overlapping with each other;

an adjusting device; and a main body for holding the blades at a front end of the main body, wherein:

the adjusting device comprises:

an attachment attached to the main body so as to overlap with the blades, and a handle ring having a circular hollow cylindrical shape and attached to the main body so as to be rotatable around a central axis of the main body extending in a forward and rearward direction;

the attachment is provided with a first cam groove and a second cam groove, and the handle ring is provided with a first linking pin and a second linking pin;

the attachment and the handle ring are connected by fitting the first linking pin and the second linking pin into the first cam groove and the second cam groove respectively, thereby, when the handle ring is rotated, the first linking pin and the second linking pin move along the first cam groove and the second cam groove respectively to move the attachment in the forward and rearward direction to cause a change in a clipping height determined by a relative position of the attachment to the blades in the forward and rearward direction;

the attachment includes:

an attachment part overlapping with the blades, and a slider part attached to the handle ring by the first linking pin, the second linking pin, the first cam groove, and the second cam groove;

the attachment part is detachably attached to the slider part;

the hair clipper further comprises a head detachably coupled to the front end of the main body;

the head includes a cover block arranged to cover the front end of the main body, and the two comb-shaped blades detachably attached to the cover block;

the slider part is disposed inside the handle ring, is provided at its outer periphery with the first cam groove and the second cam groove, and is provided with a pair of arm portions extending to a front side thereof;

the attachment part further includes a pair of linking arms protruding toward the slider part, the pair of linking arms being provided at its apex with engagement portions to be engaged with hooking portions of the pair of arm portions to define the detachable attachment between the attachment part and the slider part; and the pair of arm portions are positioned inside through holes provided to the cover block and the detachable attachment to the pair of linking arms is inside the through holes, respectively.

2. The hair clipper as set forth in claim 1, wherein the multiple first step parts each have a surface facing the front end of the main body.

3. The hair clipper as set forth in claim 2, wherein the attachment includes a comb part overlapping with a blade section defined by the blades, and the clipping height is determined by a distance between a front end of the blade section and a front end of the comb part in the forward and rearward direction.

4. The hair clipper as set forth in claim 1, wherein the second side comprises:

multiple second step parts respectively opposite to the multiple first step parts; and one or more second slope parts each interconnecting adjacent two of the multiple second step parts, and the first cam groove holds the first linking pin between a given one of the first step parts and one of the second step parts opposite the given one of the first step parts.

5. The hair clipper as set forth in claim 4, wherein the multiple second step parts are parallel to the multiple first step parts which are opposite to the multiple second step parts, respectively.

6. The hair clipper as set forth in claim 5, wherein a distance between the first step parts and the second step parts which are opposite to each other is equal to a dimension of the first linking pin in the forward and rearward direction.

7. The hair clipper as set forth in claim 1, wherein the first and second linking pins are arranged such that, when the first linking pin is positioned at any one of the multiple first step parts of the first cam groove, the second linking pin is positioned at any one of the multiple third step parts of the second cam groove.

8. The hair clipper as set forth in claim 1, wherein the hair clipper further comprises a driving device housed in the main body, and the driving device is configured to reciprocate one of the two comb-shaped blades relative to the other of the two comb-shaped blades in a predetermined reciprocation direction crossing the forward and rearward direction.

9. The hair clipper as set forth in claim 8, wherein the extension parts are on opposite sides of the handle ring in the predetermined reciprocation direction.

10. The hair clipper as set forth in claim 1, wherein:

the first cam groove includes a first side and a second side opposite to each other in the forward and rearward direction; and the first side includes multiple first step parts which extend in a direction normal to the forward and rearward direction and are in different positions in the forward and rearward direction respectively associated with different clipping heights, and one or more first slope parts each interconnecting adjacent two of the multiple first step parts.

11. The hair clipper as set forth in claim 10, wherein:

the second cam groove includes a third side and a fourth side opposite to each other in the forward and rearward direction; and the third side includes multiple third step parts which extend in a direction normal to the forward and rearward direction and are in different positions in the forward and rearward direction respectively associated with the different clipping heights, and one or more third slope parts each interconnecting adjacent two of the multiple third step parts.

12. The hair clipper as set forth in claim 1, wherein the first and second cam grooves are parallel to each other and have different widths.

13. The hair clipper as set forth in claim 1, wherein the first and second linking pins face each other in a direction normal to a direction of the central axis of the handle ring; and the first and second cam grooves are provided at an angular interval of 180 degree.

14. The hair clipper as set forth in claim 1, wherein the main body is provided at its sides with extension parts designed to cover an outer periphery of the handle ring.

* * * * *